US009857065B2

(12) United States Patent
Park

(10) Patent No.: US 9,857,065 B2
(45) Date of Patent: Jan. 2, 2018

(54) CEILING-EMBEDDED TYPE LINEAR LIGHTING DEVICE

(71) Applicant: LINNO., LTD., Namyangju (KR)

(72) Inventor: Hyun Yong Park, Seoul (KR)

(73) Assignee: LINNO., LTD., Namyangju-si (KR)

( * ) Notice: Subject to any disclaimer, the term of this patent is extended or adjusted under 35 U.S.C. 154(b) by 282 days.

(21) Appl. No.: 14/419,650

(22) PCT Filed: Mar. 4, 2014

(86) PCT No.: PCT/KR2014/001778
§ 371 (c)(1),
(2) Date: Apr. 28, 2015

(87) PCT Pub. No.: WO2014/137143
PCT Pub. Date: Sep. 12, 2014

(65) Prior Publication Data

US 2015/0292719 A1 Oct. 15, 2015

(30) Foreign Application Priority Data

Mar. 4, 2013 (KR) ..... 10-2013-0022656

(51) Int. Cl.
*F21S 4/00* (2016.01)
*F21V 21/04* (2006.01)
(Continued)

(52) U.S. Cl.
CPC ..... *F21V 21/049* (2013.01); *F21S 2/00* (2013.01); *F21S 8/026* (2013.01); *F21V 19/004* (2013.01);
(Continued)

(58) Field of Classification Search
CPC .... F21V 21/049; F21V 19/004; F21V 21/025; F21V 21/044; F21V 23/06; F21V 23/023;
(Continued)

(56) References Cited

U.S. PATENT DOCUMENTS 3,748,460 A * 7/1973 Price ..... F21S 8/02 362/347
5,609,414 A * 3/1997 Caluori ..... F21S 8/02 248/27.1
2012/0051050 A1 3/2012 Lee

FOREIGN PATENT DOCUMENTS

DE 202011000426 U1 6/2011
EP 1293724 A1 3/2003
(Continued)

*Primary Examiner* — Karl D Frech
(74) *Attorney, Agent, or Firm* — Patent Office of Dr. Chung Park

(57) ABSTRACT

A ceiling-embedded type linear lighting device includes: a housing having a receiving space formed therein and having an open side at one end; and at least one lighting module including: a light emitting body including a plurality of light emitting devices disposed on a substrate in a length direction thereof, a fixing plate allowing the light emitting body to be fixed thereto, and elastic portions disposed to be inclined from both side surfaces of the fixing plate so as to be elastically supported by an inside surface of the housing at the receiving space, so that the lighting module is vertically, detachably coupled to an interior of the receiving space from a front of the open side of the receiving space of the housing. The elastic portions and the inside surface of the housing at the receiving space are provided with two coupling portions that are engaged to each other.

13 Claims, 9 Drawing Sheets

(51) Int. Cl.

| | |
|---|---|
| ***F21S 2/00*** | (2016.01) |
| ***F21S 8/02*** | (2006.01) |
| ***F21V 19/00*** | (2006.01) |
| ***F21V 23/06*** | (2006.01) |
| ***F21V 21/02*** | (2006.01) |
| *F21V 23/02* | (2006.01) |
| *F21Y 103/10* | (2016.01) |
| *F21Y 115/10* | (2016.01) |

(52) U.S. Cl.
CPC ..... *F21V 21/025* (2013.01); *F21V 21/044* (2013.01); *F21V 23/06* (2013.01); *F21V 23/023* (2013.01); *F21Y 2103/10* (2016.08); *F21Y 2115/10* (2016.08)

(58) Field of Classification Search
CPC ..... F21S 2/00; F21S 8/026; F21Y 2103/10; F21Y 2115/10
USPC ..... 362/366, 365, 221, 347; 248/27.1
See application file for complete search history.

(56) References Cited

FOREIGN PATENT DOCUMENTS

| | | | |
|---|---|---|---|
| EP | 14759641.5 | | 9/2016 |
| JP | 05-057709 | A | 7/1993 |
| JP | 2011-249222 | A | 12/2011 |
| JP | 2012-150960 | A | 8/2012 |
| KR | 20-03851460000 | Y1 | 5/2005 |
| KR | 10-2010-0000120 | U | 1/2010 |
| KR | 20-2010-0000120 | U | 1/2010 |
| KR | 10-09494520000 | B1 | 3/2010 |
| KR | 10-2011-0020358 | A | 3/2011 |

* cited by examiner

CEILING-EMBEDDED TYPE LINEAR LIGHTING DEVICE

CROSS-REFERENCE TO PRIOR APPLICATIONS

This application is a national Stage Patent Application of PCT International Patent Application No. PCT/KR2014/001778, filed on Mar. 4, 2014, under 35 U.S.C. §371, which claims priority of Korean Patent Application No. 10-2013-0022656, filed on Mar. 4, 2013, which are all hereby incorporated by reference in their entirety.

TECHNICAL FIELD

The present invention relates to a ceiling-embedded type linear lighting device and more particularly to, a ceiling-embedded type linear lighting device allowing a lighting module to be simply attached to or detached from a ceiling-embedded type housing, as well as allowing for improvements in utilization efficiency of illumination light of the lighting module.

BACKGROUND ART

In general, ceiling bars may be fixedly installed on the ceiling at predetermined intervals, and ceiling finishing panels may be fixedly coupled to lower ends of the ceiling bars to thereby cover wirings, air ducts or the like, disposed in the insides of the ceiling bars.

In addition, a ceiling-embedded type lighting apparatus installed on the ceiling may be embedded into a space generated by removing a portion of the ceiling finishing panel, and a frame part of the lighting apparatus may be fixed to and installed on the ceiling bar.

In general, the frame part of the lighting apparatus may be screw-coupled with the ceiling bar using a bolt to thereby be fixed thereto. In this case, the bolt may penetrate through the frame part of the lighting apparatus in an inward direction to thereby be coupled to the ceiling bar, such that a head portion of the bolt may be exposed to the outside of the frame part to cause damage to the exterior of lighting equipment.

Thus, in some lighting apparatuses, a closure covering the head portion of the bolt may be coupled to the frame part to prevent the head portion of the bolt from being exposed. However, since the closure may also be protruded from an exterior surface of the frame part, it may be difficult to consider that defects causing damage to the exterior of the lighting apparatus have been solved.

In addition, in lighting apparatuses according to the related art, a frame part may be directly, fixedly fastened to a ceiling bar by using a bolt.

Thus, in the case that defects are generated in a light source unit, a power supply (stabilizer), a wiring or the like, embedded in the frame part of the lighting apparatus and accordingly, a maintenance work therefor is required, the entirety of the lighting apparatus may be detached from the ceiling bar and then, a maintenance work may be performed. At this time, in the majority of cases, since a length of a wiring supplying external power is insufficient to lay down the lighting apparatus detached from the ceiling bar on an indoor bottom surface, a maintenance work is somewhat troublesome. In addition, it may be difficult for an operator to grasp a lighting apparatus by the operator's one hand as well as to perform a maintenance work by the operator's the other hand in a range in which the length of the wiring is secured. Otherwise, performing a maintenance work by two operators would be a waste of manpower.

In other words, in lighting apparatuses according to the related art, since the entirety of the lighting apparatus needs to be detached and separated from the ceiling bar in order to conduct the maintenance work, the maintenance work is considerably troublesome.

DETAILED DESCRIPTION OF THE INVENTION

Technical Problem

Therefore, an aspect of exemplary embodiments of the present invention may provide a ceiling-embedded type linear lighting device, capable of facilitating maintenance thereof without a separate tool, by allowing a lighting module including a light emitting element to be simply attached to or detached from a housing without a separate fastening element.

In addition, an aspect of exemplary embodiments of the present invention may also provide a ceiling-embedded type linear lighting device, capable of providing stable fixation force so as to prevent the housing to be arbitrarily separated and dropped from an installation object, as well as to allow the housing to be easily installed on and be separated from the installation object.

Solution to Problem

According to an embodiment of the present invention, a ceiling-embedded type linear lighting device may include: a housing having a receiving space formed therein and having an open side at one end; and at least one lighting module including: a light emitting body including a plurality of light emitting devices disposed on a substrate in a length direction thereof, a fixing plate allowing the light emitting body to be fixed thereto, and elastic portions disposed to be inclined from both side surfaces of the fixing plate so as to be elastically supported by an inside surface of the housing at the receiving space, so that the lighting module is vertically, detachably coupled to an interior of the receiving space from a front of the open side of the receiving space of the housing, wherein the elastic portions and the inside surface of the housing at the receiving space are provided with a first coupling portion and a second coupling portion, the first coupling portion and the second coupling portion being engaged with each other.

An inside surface of at least one of the fixing plate and the elastic portions of the lighting module may be provided with a reflective surface reflecting illumination light of the light emitting devices toward the open side of the receiving space.

A handle portion may be extended from the end portion of the elastic portions so as to release the engagement of the first coupling portion with the second coupling portion, the handle portion being spaced apart from the inside surface of the housing at the receiving space.

At least one of the surfaces on which the first coupling portion and the second coupling portion are engaged with each other may be formed as an inclined surface guiding a separation of the lighting module.

The ceiling-embedded type linear lighting device may further include: stopper members which are protruded from the inside surface of the housing and which guide an insertion position of the fixing plate.

Rail grooves may be formed in the inside surface of the housing in a length direction thereof, and the stopper members may be movably inserted into and supported by the rail grooves.

The ceiling-embedded type linear lighting device may further include: a light transmissive cover which closes the open side of the housing.

The lighting module may be provided with a switching mode power supply (SMPS) for stably supplying power to the light emitting devices of the light emitting body, and sockets are provided on the substrate of the light emitting body so as to provide connection of power between substrates, the sockets of the substrate being connected to each other by a connection line to thereby allow a plurality of light emitting bodies to stably receive power by a single SMPS.

The switching mode power supply (SMPS) may be provided in plural and each of the plurality of switching mode power supplies (SMPS) may be provided with an input line receiving power and an output line supplying the power to the light emitting devices, and the input line of one of the plurality of switching mode power supplies (SMPS) may be connected to an external power line, and an input line of at least one of the remaining switching mode power supplies (SMPS) may be connected to the input line of the switching mode power supply (SMPS) receiving power from the external power line.

The ceiling-embedded type linear lighting device may further include: a fixing member having inclined portions inclined downwardly from both sides thereof and disposed on an upper portion of the housing; and a connecting member connecting the fixing member and the housing to each other to allow the fixing member to move in a vertical direction, wherein supporting jaw portions are formed to protrude from both side surfaces of an end portion of the open side of the housing, and wherein in a state in which the upper portion of the housing is inserted in an installation groove provided in an installation object, the inclined portions penetrate through the installation groove and are supported by an inside surface of the installation object, and the supporting jaw portions are supported by an outside surface of the installation object.

The inclined portions may be elastically supported in a direction apart from the side surface of the housing.

A supporting portion may be formed on the end portion of the inclined portions supported by the inside surface of the installation object, the supporting portion forming a right angle with respect to the inside surface of the installation object.

The connecting member may include a central plate connecting the inclined portions disposed on the both side surfaces of the housing.

The connecting member may have a front end thereof which penetrates through the housing and which is screw-coupled with the central plate of the fixing member and a rear end thereof supported by the housing.

Advantageous Effects of the Invention

According to the present invention, a ceiling-embedded type linear lighting device is provided which is capable of facilitating maintenance thereof without a separate tool, by allowing a lighting module including a light emitting element to be simply attached to or detached from a housing without a separate fastening element.

In addition, the present invention provides a ceiling-embedded type linear lighting device, capable of providing stable fixation force so as to prevent the housing to be arbitrarily separated and dropped from an installation object, as well as to allow the housing to be easily installed on and be separated from the installation object.

MODE FOR INVENTION

Figure 1:
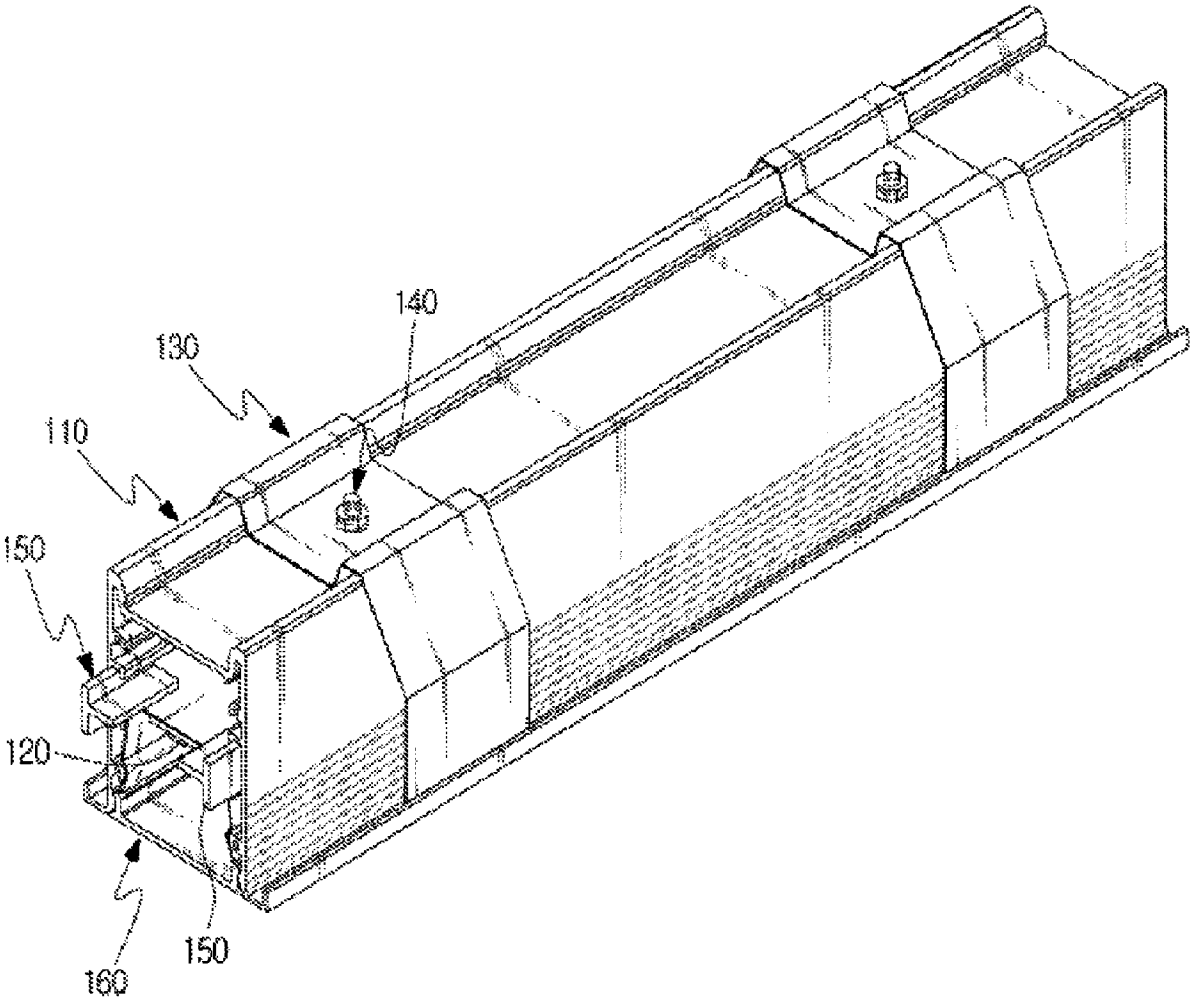
FIG. 1 is a partially cut-away perspective view of a ceiling-embedded type linear lighting device according to an exemplary embodiment of the present invention.

Prior to the description, in several embodiments, components having the same configurations will be described using the same reference numerals representatively in a first exemplary embodiment, and other components different from those of the first exemplary embodiment will be described in other exemplary embodiments.

Hereinafter, a ceiling-embedded type linear lighting device according to the first exemplary embodiment of the present invention will be described in detail with reference to the attached drawings.

Figure 2:
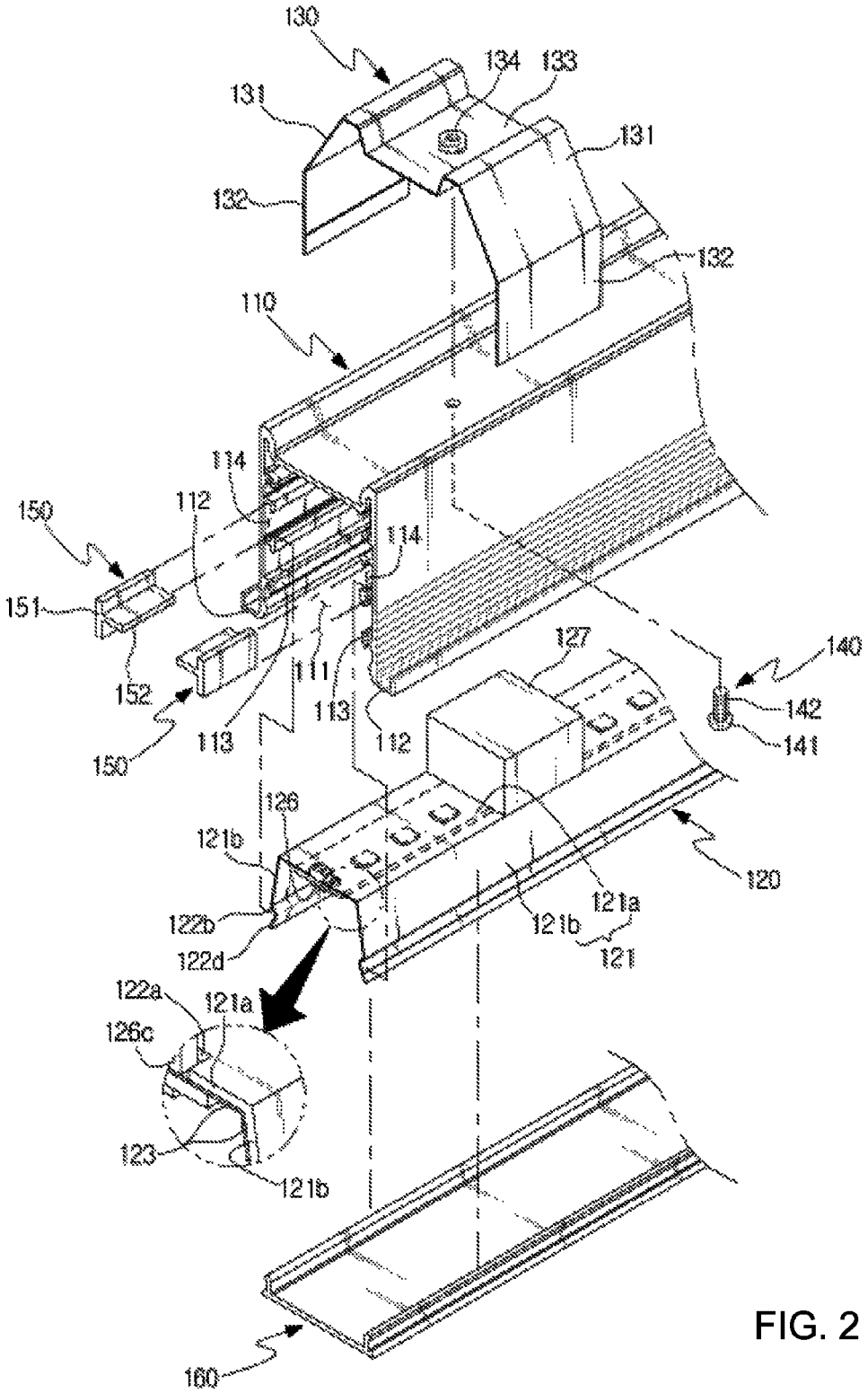
FIG. 2 is an exploded perspective view of the ceiling-embedded type linear lighting device according to an exemplary embodiment of the present invention.
Figure 3:
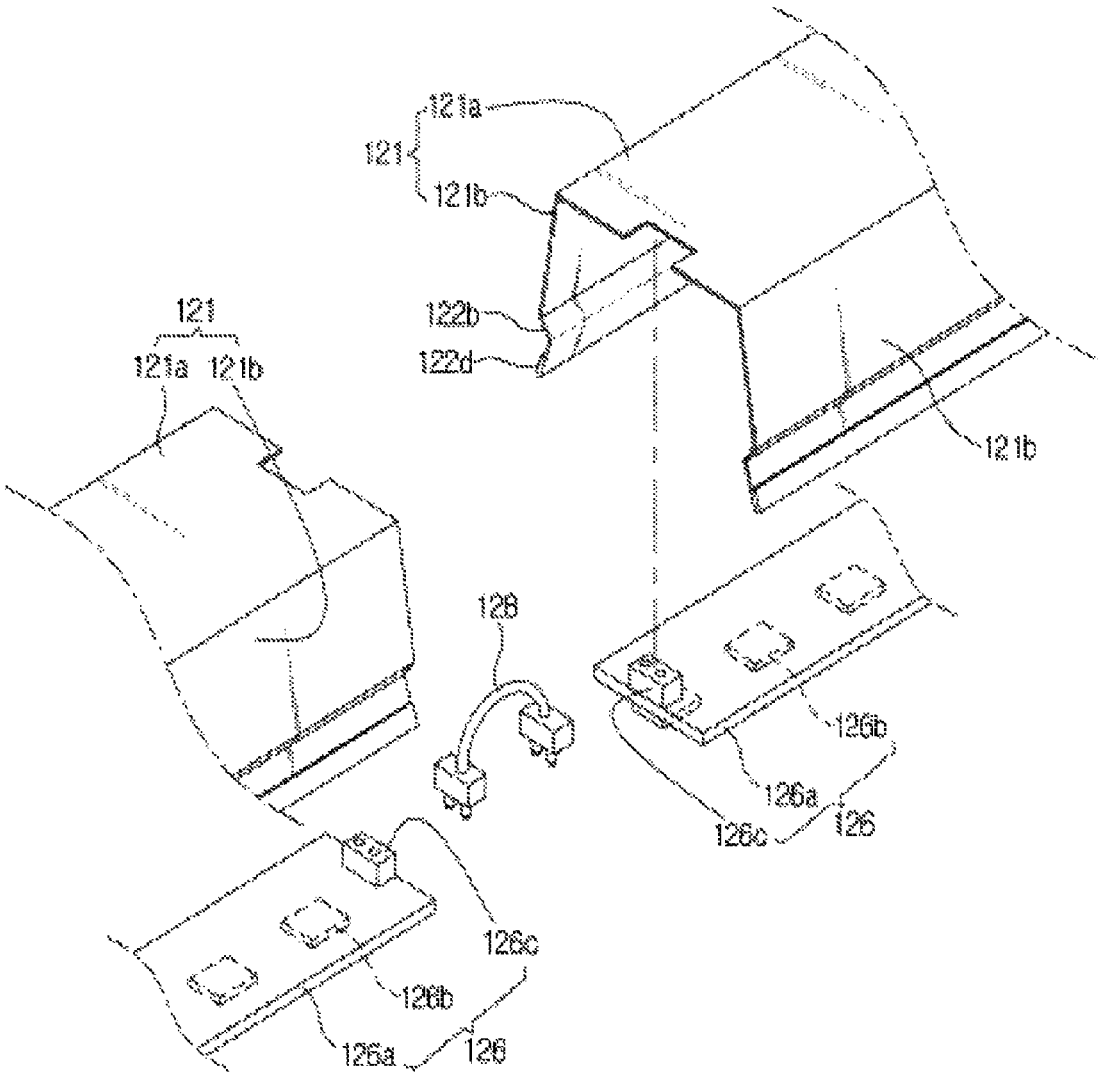
FIG. 3 is an exploded perspective view of a lighting module of the ceiling-embedded type linear lighting device according to an exemplary embodiment of the present invention.

FIG. 1 is a partially cut-away perspective view of a ceiling-embedded type linear lighting device according to an exemplary embodiment of the present invention. FIG. 2 is an exploded perspective view of the ceiling-embedded type linear lighting device according to an exemplary embodiment of the present invention.

The ceiling-embedded type linear lighting device according to an exemplary embodiment of the present invention as illustrated in FIGS. 1 and 2 may be configured to include a housing 110, a lighting module 120, a fixing member 130, a connecting member 140, and stopper members 150.

In order to configure linear illumination, the housing 110 may be embedded in an installation groove C1 previously formed in an installation object C such as a ceiling structure in a length direction thereof. The housing 110 may have a receiving space 111 formed therein, the receiving space 111 having one side thereof opened to install the lighting module 120 therein. An upper end of the housing 110 may be inserted and received in the installation groove C1 of the installation object C, and lower ends of the housing 110 may have supporting jaw portions 112 formed on outer surfaces thereof, the supporting jaw portions 112 being closely adjacent to an outer circumferential surface of the installation groove C1. In addition, first coupling portions 113 engaged with second coupling portions 122*b* of the lighting module 120 to be described later and rail grooves 114 to which the stopper members 150 are fixed may be respectively formed in the length direction of the housing on both inside surfaces of the receiving space 111 of the housing 110, the inside surfaces facing each other.

The fixing member 130 may be disposed on one portion of the housing 110 so as to be movable in an insertion direction of the housing 110. The fixing member 130 may include: a pair of inclined portions 131 inclinedly disposed on both side surfaces of the housing 110 in such a manner that the inclined portions 131 are elastically compressed and closely adjacent to the side surfaces of the housing 110 in a process of inserting one portion of the housing 110 in the installation groove C1 while the inclined portions 131 are elastically restored in a state in which one portion of the housing 110 is inserted in the installation groove C1; supporting portions 132 extended from end portions of the inclined portions 131 contacting inner side surfaces of the installation object C so as to form a right angle with respect to the inner side surfaces of the installation object C; a central plate 133 disposed on an upper portion of the housing 110 and connecting the pair of inclined portions 131 to each other; and a first screw portion 134 formed on the central plate 133 to be screw-coupled with a connecting member 140 to be described later. Meanwhile, the inclined potions 131 bent and inclined from edges of the central plate 133 may be elastically supported in a direction apart from the side surfaces of the housing 110 by elastic force of the fixing member 130.

The fixing member 130 may be previously manufactured in various sizes depending on a thickness of the installation object C. Accordingly, a type of the fixing member 130 may be appropriately selected depending on a thickness of the installation object C, a subject to be installed.

The connecting member 140 may be formed to have a screw shape and have one end thereof provided with a head portion 141 and exposed to the receiving space 111. The other end of the connecting member 140 penetrating through the housing 110 to be exposed upwardly may be provided with a second screw portion 142 screw-coupled to the first screw portion 134, such that the connecting member 140 may be rotatably supported by the housing 110. Thus, in the case of rotating the head portion 141 exposed to the receiving space 111 using a tool such as a screw driver, the fixing member 130 may move in a direction in which the housing 110 is inserted, that is, in a direction away from the upper surface of the housing 110, or in a direction toward an upper surface of the housing 110, in accordance with a direction of rotation of the connecting member 140.

The lighting module 120 may be configured to include a detachable member 121, a light emitting body 126, and a switching mode power supply (SMPS) 127.

The detachable member 121 may include: a fixing plate 121*a* in which the light emitting body 126 is disposed within the receiving space 111 while being fixed to a lower surface of the fixing plate 121*a* toward the open side of the receiving space 111; elastic portions 121*b* bent and inclined downwardly from both sides of the fixing plate 121*a* to be elastically supported by inside walls of the receiving space 111; the second coupling portions 122*b* bent from ends of the elastic portions 121*b* and engaged with the first coupling portions 113 of the housing 110; handle portions 122*d* bent from ends of the second coupling portions 122*b* and disposed to be spaced apart from inside surfaces of the receiving space 111 so as to move the second coupling portions 122*b* in a direction separating from the first coupling portions 113; and reflective surfaces 123 formed by applying or coating a light reflective material to or on the lower surface of the fixing plate 121*a* and inside surfaces of the elastic portions 121*b*, that is, surfaces facing the open side of the housing 110, or formed of a material having excellent light reflectance efficiency so as to reflect illumination light of the lighting module 120 toward the open side of the receiving space 111.

Here, both end portions of the fixing plate 121*a* to which the light emitting body 126 is fixed may be provided with through holes 122*a* through which sockets 126*c* of the light emitting body 126 penetrate to thereby be exposed upwardly from the fixing plate 121*a*, and the second coupling portions 122*b* engaged with the first coupling portions 113 may be formed as inclined surfaces for guiding the separation of the lighting module 120.

The light emitting body 126 may be provided in plural, and the plurality of light emitting bodies 126 may be disposed in the receiving space 111 of the housing 110 in the length direction thereof. Each of the plurality of light emitting bodies 126 may include a circuit substrate 126*a*, a plurality of light emitting devices 126*b* such as LEDs provided in a length direction of the circuit substrate 126*a*, and the sockets 126*c* for power input/output, formed on both ends of the circuit substrate 126*a*.

The switching mode power supply (SMPS) 127 disposed on the upper surface of the fixing plate 121*a* to stably supply power to the light emitting body 126 may be provided with an input line 127*a* to which external power is input and an output line 127*b* supplying power to the light emitting devices of the light emitting body.

The lighting module 120 may be provided in plural, and the plurality of lighting modules 120 may be disposed in a row within the receiving space. In the event that the plurality of lighting modules 120 receive power by a single SMPS 127 depending on capacity of the SMPS 127, the plurality of lighting modules 120 may be configured in such a manner that the SMPS 127 may be disposed on at least one of the plurality of lighting modules 120, and the remaining lighting modules 120 on which the SMPS 127 is not disposed may be electrically connected to each other by a connecting line 128 to receive power from the at least one lighting module on which the SMPS 127 is disposed. The connecting line 128 may be configured to include connecting plugs connected to the sockets 126*c* so as to connect the sockets 126*c* of the circuit substrates 126*a* adjacent to each other between a pair of the light emitting bodies 126, and a conducting line connecting the connecting plugs, such that the light emitting bodies 126 may be electrically connected to each other. (Please refer to FIG. 9)

The stopper members 150 for guiding an insertion position of the fixing plate 121*a* may include insertion portions 151 provided in rear ends of the stopper members 150, the insertion portions 151 being slidably inserted into and supported by the rail grooves 114 of the housing 110, and catching portions 152 provided in front ends of the stopper members 150, the catching portions 152 being protruded toward the receiving space 111 of the housing 110 so as to limit a depth into which the fixing plate 121*a* is inserted. In a state in which a plurality of housings 110 are disposed in a row, the stopper members 150 may connect a pair of the housings 110 while respective ends of the insertion portions 151 are individually inserted in the rail grooves 114 of the two housings 110, such that the occurrence of a stepped portion in a connection region between the pair of housings 110 may be prevented.

Meanwhile, to the opening of the receiving space 111 of the housing 110, a light transmissive cover 160 diffusing illumination light provided toward the opening after having been emitted from the light emitting body 126 may be detachably coupled.

Hereinafter, operations of a ceiling-embedded type linear lighting device according to a first exemplary embodiment of the present invention will be described.

Figure 4:
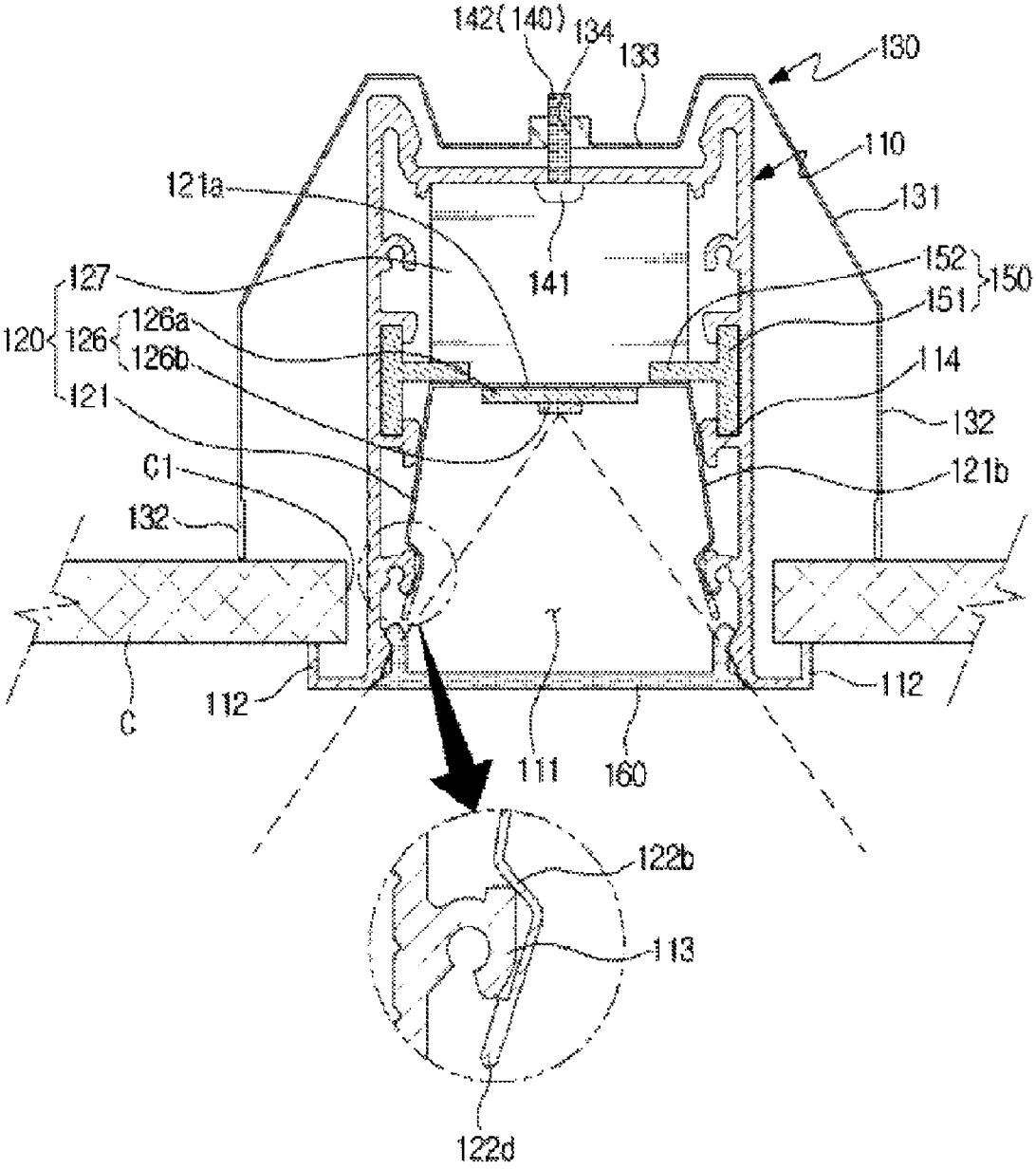
FIG. 4 is a cross-sectional view of the ceiling-embedded type linear lighting device according to an exemplary embodiment of the present invention.

FIG. 4 is a cross-sectional view of the ceiling-embedded type linear lighting device according to an exemplary embodiment of the present invention. FIGS. 5 through 8 are operational views illustrating a process of installing the ceiling-embedded type linear lighting device according to an exemplary embodiment of the present invention.

First, a coupled structure of the ceiling-embedded type linear lighting device according to an exemplary embodiment of the present invention as illustrated in FIG. 4, is considered. In a state in which the supporting jaw portions 112 formed on outer circumferential portions of the lower ends of the housing 110 are supported by the outer circumferential surface of the installation groove C1 of the installation object C, the two inclined portions 131 of the fixing member 130 disposed on the upper portion of the housing 110 may come into contact with an inner circumferential surface of the installation groove C1 of the installation object C, such that a state in which the housing 110 is stably fixed into the installation groove C1 of the installation object C may be maintained.

The fixing member 130 may be screw-coupled with the connecting member 140 penetrating through the housing 110. Accordingly, the fixing member 130 may move in the thickness direction of the installation object C, that is, in a vertical direction in the drawings, in accordance with the direction of rotation of the connecting member 140.

Thus, in a state in which the fixing member 130 moves in a direction away from the housing 110, when the housing 110 is inserted into the installation groove C1, the both inclined portions 131 of the fixing member 130 may contact the installation groove C1 and be elastically compressed to thereby be inserted into the installation groove C1. Then, when the inclined portions 131 of the fixing member 130 are inserted into the installation groove C1, the inclined portions 131 in an elastically compressed state may be elastically restored and be further spaced apart from the side surfaces of the housing 110. Therefore, in a state in which the housing 110 is inserted in the installation groove C1, the separation of the housing 110 from the installation groove C1 may be prevented. In addition, in the case that the fixing member 130 is moved in a direction toward the housing 110 by rotating the connecting member 140, the supporting portions 132 formed on the end portions of the inclined portions 131 may be closely adhered to an inside wall of the installation object C, whereby the housing 110 may be stably fixed to the installation object C. In this case, the supporting portions 132 may be disposed to form a substantially right angle with respect to the inside surface of the installation object C. Thus, even in the case that a load acts in the direction away from the housing 110, a phenomenon in which the inclined portions 131 are arbitrarily moved to result in deterioration in fixation force of the detachable member 121 may be prevented.

Meanwhile, the insertion portions 151 of the stopper members 150 may be respectively coupled to the rail grooves 114 formed in the centers of inner surfaces of both sidewalls of the housing 110, such that the catching portions 152 of the stopper members 150 may protrude toward the receiving space 111 from the sidewalls of the housing 110.

Then, when the detachable member 121 to which the light emitting body 126 of the lighting module 120 is fixed is vertically inserted into the receiving space 111 from the front of the opening of the receiving space through the opening of the housing 110, the fixing plate 121*a* may contact the catching portions 152 of the stopper members 150 and the insertion position of the detachable member 121 may be guided. In a process of inserting the fixing plate 121*a*, a pair of the elastic portions 121*b* inclinedly disposed on both sides of the fixing plate 121*a* may be closely adhered to the inner surfaces of the sidewalls of the housing 110 and be elastically compressed, thereby being elastically supported by the sidewalls. The second coupling portions 122*b* of the elastic portions 121*b* may be engaged with the first coupling portions 113 of the housing 110 and accordingly, positions thereof may be fixed.

In addition, the SMPS 127 disposed on the upper surface of the fixing plate 121*a* may be arranged not to interfere with the stopper members 150. The SMPS 127 may be disposed within an internal region of the receiving space 111. When the detachable member 121 is inserted into the receiving space 111, the SMPS 127 may be in contact with the upper surface of the housing 110.

In the lighting module 120 as described above, the fixing plate 121*a* may be supported by the stopper members 150 and be guided to the insertion position thereof, and the second coupling portions 122*b* of the elastic portions 121*b* may be engaged with the first coupling portions 113 of the housing 110, to thereby prevent the detachment of the second coupling portions 122*b*. That is, even without a separate fastening element such as a screw, the lighting module 120 may be simply combined with the receiving space 111 of the housing 110 to thereby allow for simplification of the manufacturing thereof.

Meanwhile, the handle portions 122*d* may be formed on the end portions of the elastic portions 121*b*, the handle portions 122*d* being spaced apart from the inner surfaces of the sidewalls of the housing 110 in a state in which the first coupling portions 113 are engaged with the second coupling portions 122*b*. Thus, in the event that a user wishes to separate the lighting module 120 from the housing 110, the user may grasp the handle portions 122*d* and pull the elastic portions 121*b* in an elastically compressed direction, whereby the second coupling portions 122*b* may be separated from the first coupling portions 113 to separate the lighting module 120 from the receiving space 111.

In this case, since the second coupling portions 122*b* may be formed as inclined surfaces for guiding the separation of the lighting module 120, the lighting module 120 may be easily separated in a state in which the first coupling portions 113 and the second coupling portions 122*b* are separated from each other.

In addition, in a state in which the lighting module 120 is inserted into the receiving space 111 of the housing 110, the light transmissive cover 160 may be detachably coupled to the opening of the receiving space 111. That is, even in the case that the plurality of lighting modules 120 may be installed within the housing 110 to configure linear illumination, a single consecutive, linear illumination may be configured by installing a single light transmissive cover 160 on the opening of the housing 110.

Hereinafter, a process of manufacturing the ceiling-embedded type linear lighting device having the coupled structure as described above will be concretely described.

FIGS. 5 through 8 are operational views illustrating a process of installing the ceiling-embedded type linear lighting device according to an exemplary embodiment of the present invention.

Figure 5:
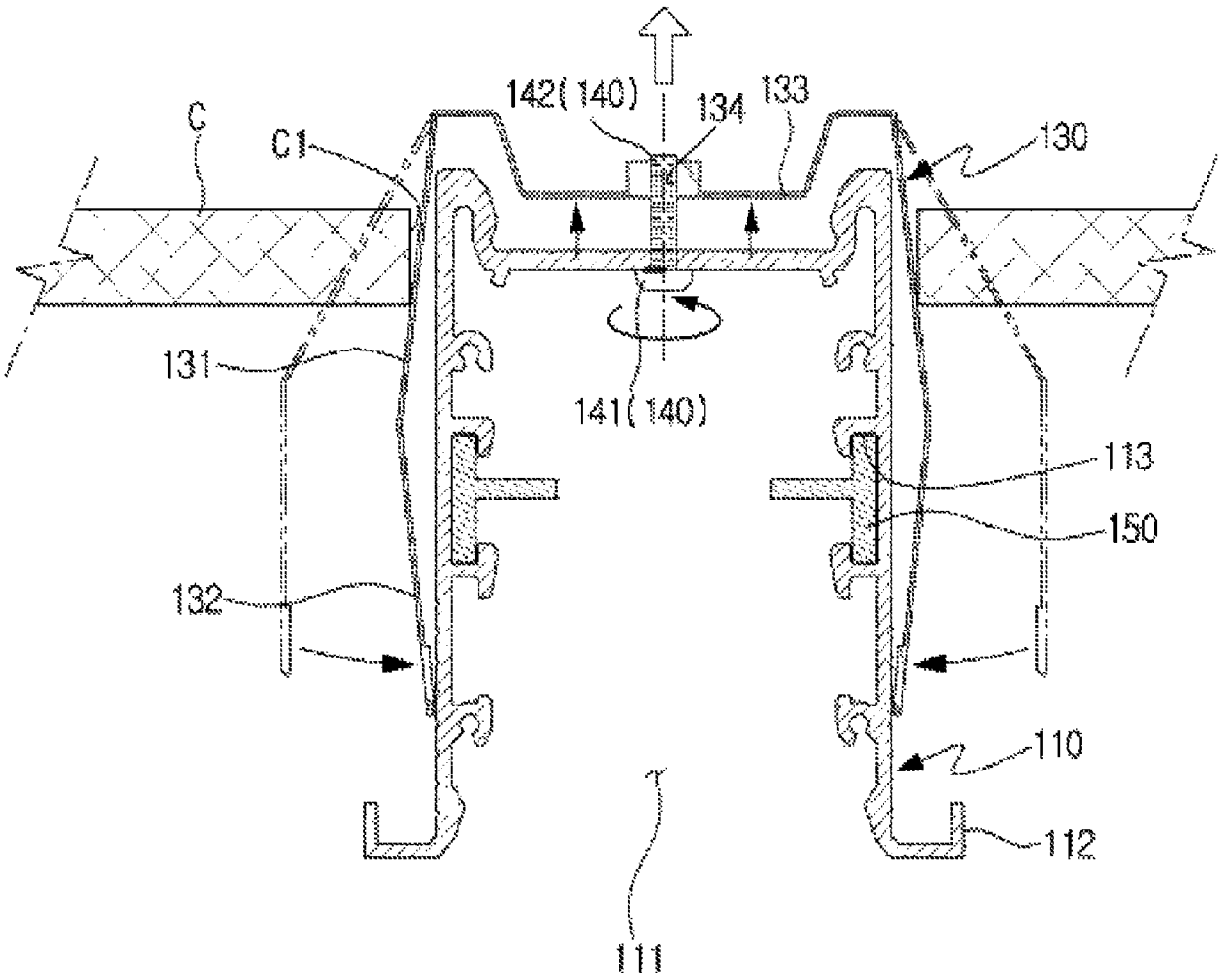
FIGS. 5 through 8 are operational views illustrating a process of installing the ceiling-embedded type linear lighting device according to an exemplary embodiment of the present invention.

First, FIG. 5 illustrates a process of inserting one portion of the housing 110 in the installation groove C1 of the installation object C.

The fixing member 130 may be connected to the upper portion of the housing 110 by the connecting member 140, and the second screw portion 142 of the connecting member 140 may be screw-coupled to the first screw portion 134 of the central plate 133 of the fixing member 130. Thus, the fixing member 130 may be movable in a direction perpendicular with respect to the housing 11 in accordance with the direction of rotation of the connecting member 140 rotatably supported by the housing 110. That is, the housing 110 is configured to be movable in the thickness direction of the installation object C in the installation groove C1.

Before the housing 110 is inserted into the installation groove C1, in the event that the head portion 141 of the connecting member 140 exposed to the receiving space 111 of the housing 110 is rotated in a tightening-releasing direction, using a tool such as a screw driver, the fixing member 130 may move in the direction away from the housing 110, that is, in an upward direction, such that a distance between the supporting portion 132 of the fixing member 130 and the supporting jaw portion 112 of the housing 110 may be increased.

Then, when the one portion of the housing 110 is inserted into the installation groove C1 of the installation object C, the inclined portions 131 of the fixing member 130 inclinedly disposed on both sides of the fixing member 130 may be inserted into a space between the installation groove C1 and the housing 110 and then, be elastically compressed. That is, the inclined portions 131 inclinedly disposed on both sides of the fixing member 130 may be maintained in a state in which they are apart from each other in opposite directions, as denoted by two point chain lines in the drawings. Then, in a process of inserting the housing 110 in the installation groove C, the inclined portions 131 may be elastically compressed in directions toward each other.

Meanwhile, the stopper members 150 for guiding the insertion position of the fixing plate 121*a* may be previously installed in the rail grooves 114 of the housing 110. In the case that the stopper members 150 are disposed on the connection region between the two housings 110 disposed in a row, the occurrence of the stepped portion between the pair of housings 110 may be prevented.

Figure 6:
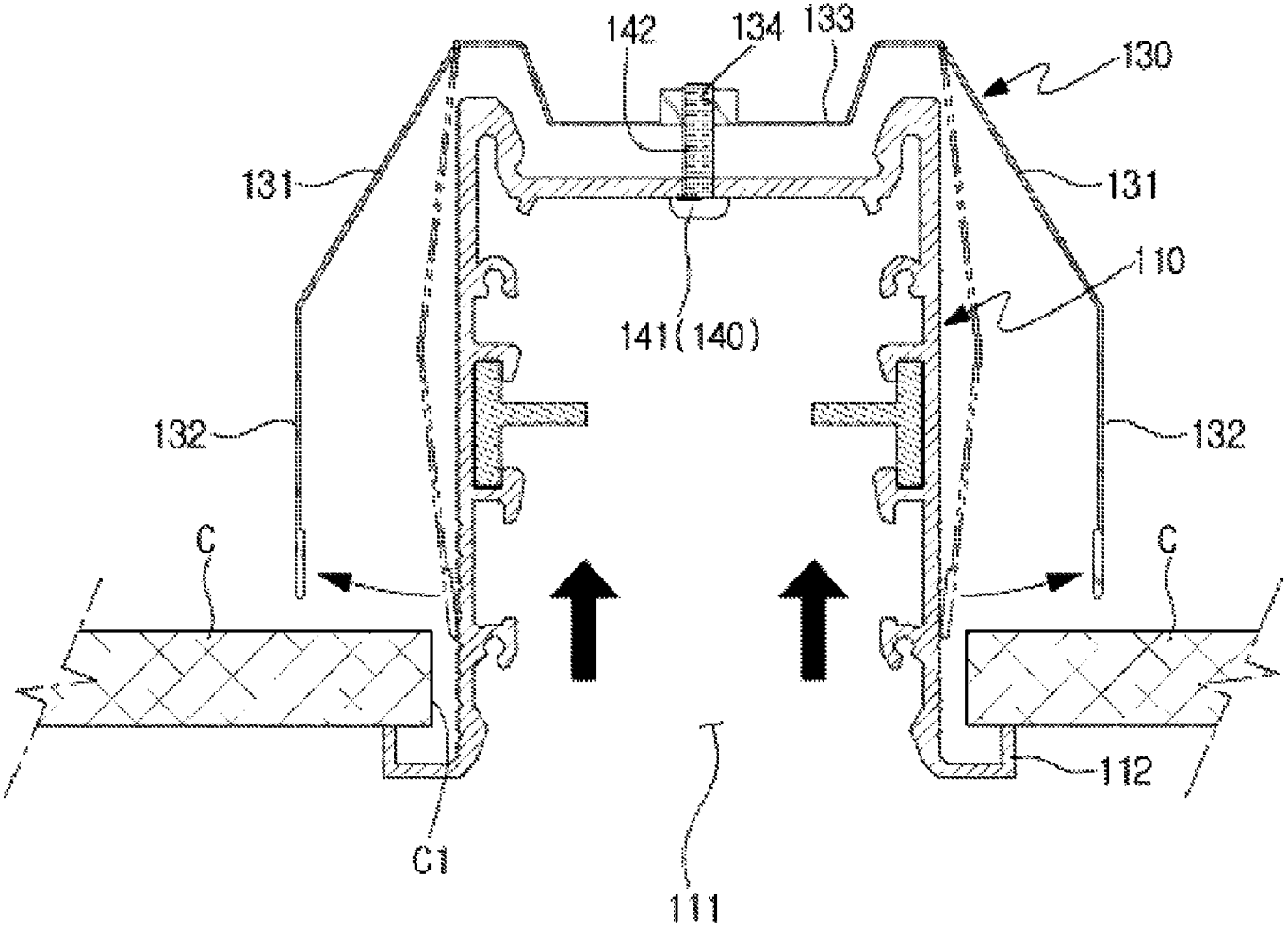

FIG. 6 is a view illustrating a state in which one portion of the housing 110 is inserted into the installation groove C1.

When one portion of the housing 110 is completely inserted into the installation groove C1 so as to allow the supporting jaw portions 112 formed on the outer circumferential surfaces of the lower ends of the housing 110 to be closely adhered to the outer circumferential surface of the installation groove C1, the supporting portions 132 of the fixing member 130 may be separated from the installation groove C1 and be elastically restored, such that the supporting portions 132 may be further spaced apart from the side surfaces of the housing 110.

Figure 7:
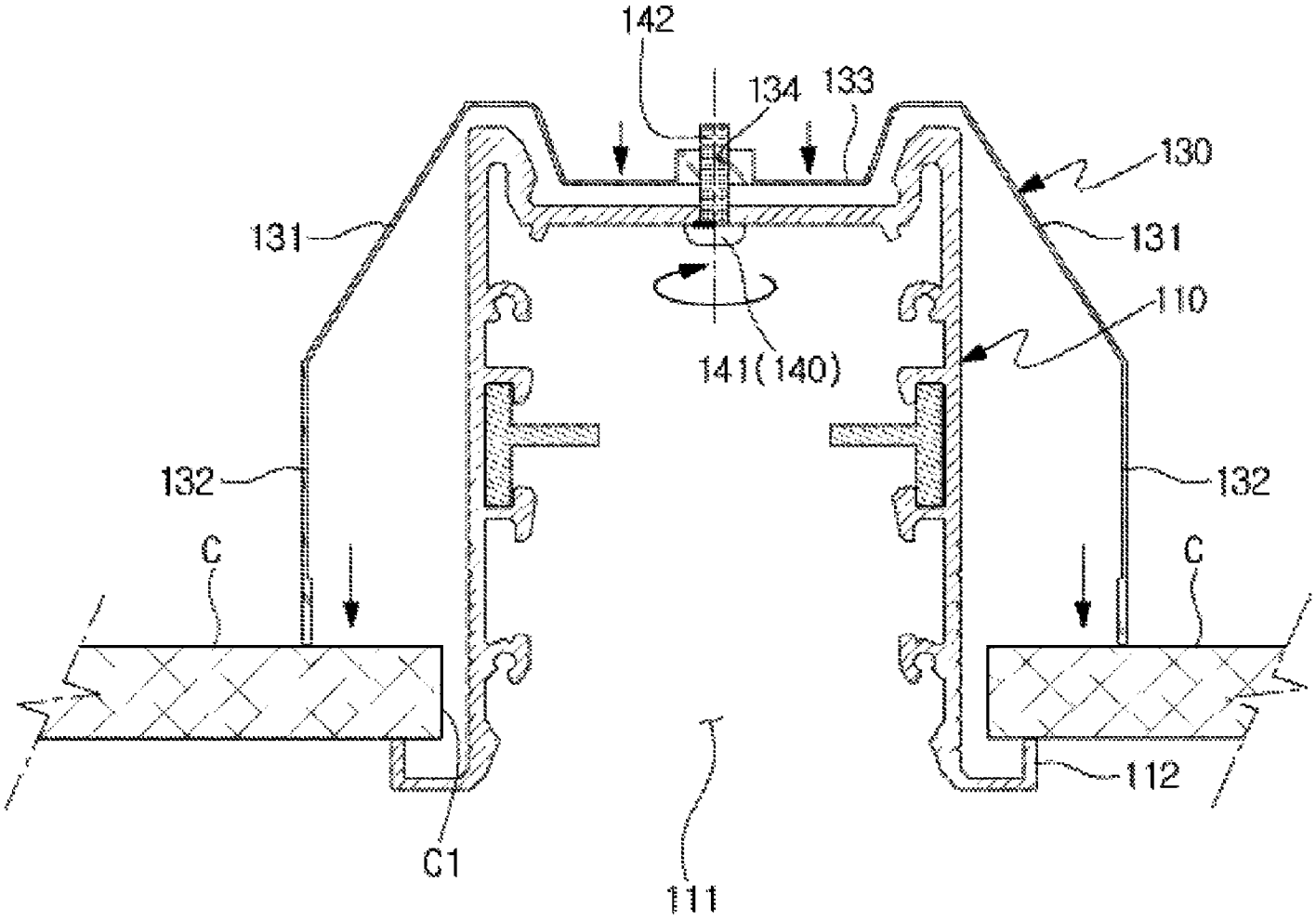

FIG. 7 is a view illustrating a state in which the fixing member 130 is moved in a direction in which a distance between the fixing member 130 and the housing 110 is reduced, that is, in a downward direction, by the rotation of the connecting member 140 in a tightening direction.

As described above, in order to allow the supporting portions 132 of the fixing member 130 to be smoothly spaced apart from the installation groove C1 in a state in which the housing 110 is inserted in the installation groove C1, the fixing member 130 may be moved in a direction away from the housing 110. In this state, since the distance between the supporting portions 132 closely adhered to and supported by the inside surface of the installation object C and the supporting jaw portions 112 closely adhered to and supported by the outside surface of the installation object C may be increased, a stable fixation may not be made in a state in which the housing 110 is inserted into the installation groove C1. (Please refer to FIG. 6.)

Thus, in a state in which one portion of the housing 110 is inserted into the installation groove C1, when the head portion 141 of the connecting member 140 exposed to the receiving space 111 of the housing 110 is rotated in a tightening direction using a tool such as a screw driver, the supporting portions 132 of the fixing member 130 may be downwardly moved, such that the distances between the supporting portions 132 of the fixing member 130 and the supporting jaw portions 112 of the housing 110 may be reduced and accordingly, the supporting portions 132 of the fixing member 130 and the supporting jaw portions 112 of the housing 110 may be closely adhered to the inside surface and the outside surface of the installation object C. That is, even in the case that external force such as vibrations or shaking is applied, since the housing 110 is stably fixed to the installation object C, it is possible to prevent the housing 110 from being temporally detached and dropped from the installation groove C1.

In addition to this, since the supporting portions 132 of the fixing member 130 may be maintained in a state in which they form right angles with respect to the installation object C, the fixing member 130, which is an elastic member, may be temporally, elastically deformed by external force to prevent the deformation of the distances between the supporting portions 132 of the fixing member 130 and the supporting jaw portions 112 of the housing 110.

Figure 8:
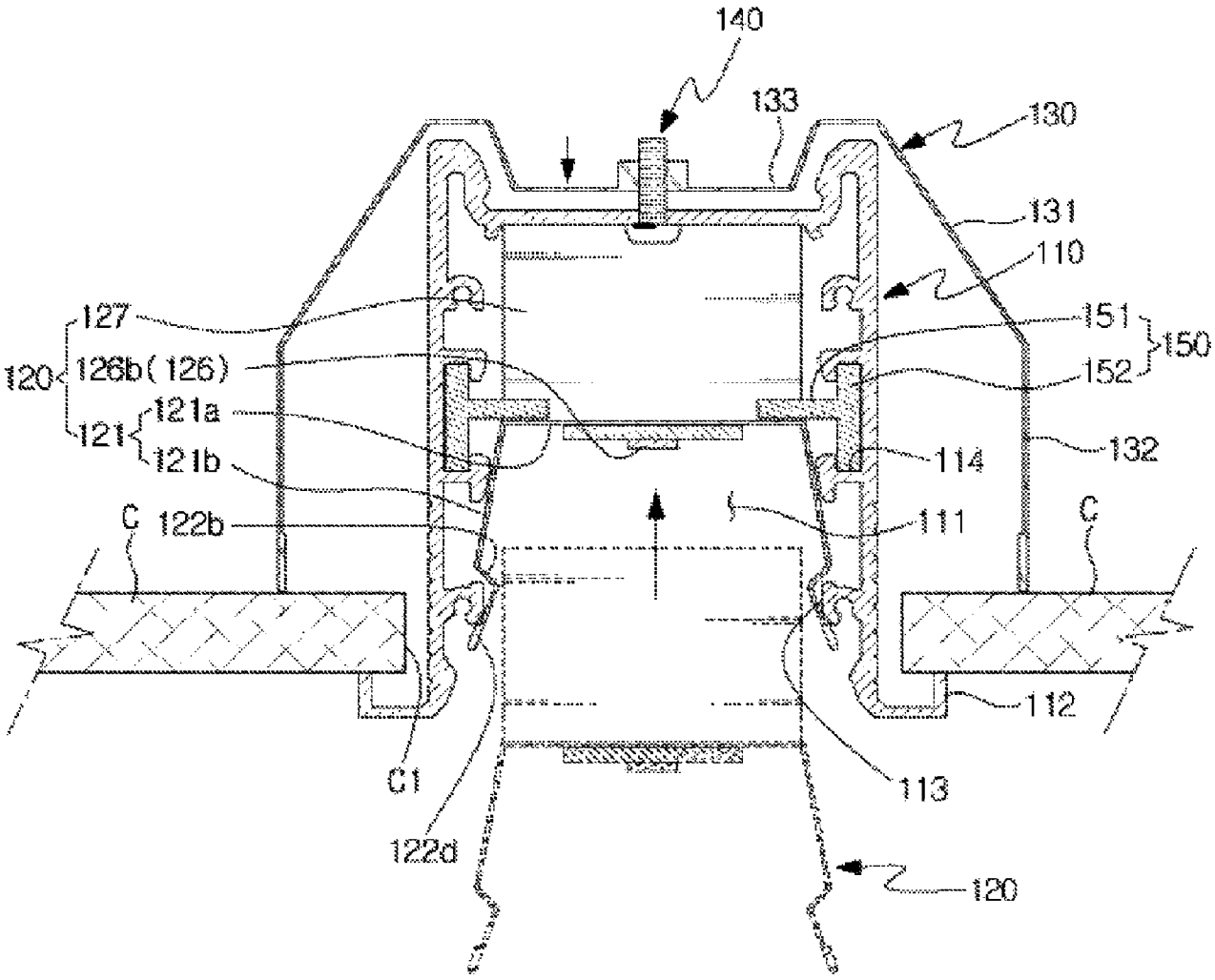

FIG. 8 is a view illustrating a process of installing the lighting module 120 in the receiving space 111 of the housing 110 installed on the installation object C.

The lighting module 120 may be configured as a single unit form by fixing the light emitting body 126 to the lower portion of the fixing plate 121*a* of the detachable member 121 and fixing the SMPS 127 to the upper surface of the fixing plate 121*a*.

Thus, when the lighting module 120 is vertically pushed in the receiving space 111 of the housing 110 installed on the installation object C, in a state in which the both elastic portions 121*b* of the detachable member 121 are elastically attached to the inner surface of the sidewalls of the housing 110 facing the receiving space 111, the upper surface of the fixing plate 121*a* may be supported by the catching portions 152 of the stopper members 150 and accordingly, the movement of the lighting module in an upward direction may be limited, and at the same time, the second coupling portions 122*b* of the elastic portions 121*b* may be engaged with the first coupling portions 113 of the housing 110 and accordingly, the movement of the lighting module in a downward direction may be limited to thereby allow for the fixation of the position thereof.

As described above, only with an operation of pushing the lighting module 120 within the housing 110, since the lighting module 120 may be simply combined with the housing 110 without a fastening element such as a separate screw, the manufacturing thereof may be facilitated.

In addition, the handle portions 122*d* provided on the elastic portions 121*b* may be spaced apart from the side surfaces of the housing 110 in a state in which the first coupling portions 113 and the second coupling portions 122*b* are engaged with each other. Thus, in the case of simultaneously grasping a pair of the handle portions 122*d* and applying force to the handle portions 122*d* in an inward direction, the elastic portions 121*b* may be elastically compressed and the second coupling portions 122*b* may be separated from the first coupling portions 113, whereby the fixation of the lighting module may be released.

That is, after the coupling of the second coupling portions 122*b* with the first coupling portions 113 is released from one end portion of the lighting module 120, using the handle portions 122*d*, when the lighting module 120 is pulled in a direction in which the lighting module 120 is separated, the one end portion of the lighting module 120 may be separated from the receiving space 111 of the housing 110. Then, when the other end portion of the lighting module 120 is pulled in the separation direction using the separated one end portion of the lighting module 120, the other end portion of the lighting module 120 may be detached from the receiving space 111, such that the lighting module 120 may be completely separated from the housing 110. According to the exemplary embodiment as described above, since the lighting module 120 may be easily separated from the housing 110, the maintenance of the lighting device may be facilitated.

In addition, the light transmissive cover 160 may be detachably coupled to the opening of the receiving space 111 of the housing 110 as illustrated in FIG. 4 to thereby diffuse light of the light emitting body 126. Accordingly, a degree of uniformity of illumination light over an overall surface of the light transmissive cover 160 may be improved and a glaring phenomenon may be prevented.

Meanwhile, the order of separating the lighting device installed on the installation object C may be made in an order reversed from the order in which the lighting device is assembled. In addition, in the case of separating the housing 110 from the installation groove C1 of the installation object C, the second screw portion 142 of the connecting member 140 may be detached from the first screw portion 134 of the fixing member 130 by consecutively rotating the connecting member 140 in the tightening-releasing direction, such that the housing 110 may be drawn from the installation groove C1 in the separation direction.

A wiring structure of the ceiling-embedded type linear lighting device may be provided as follows.

Figure 9:
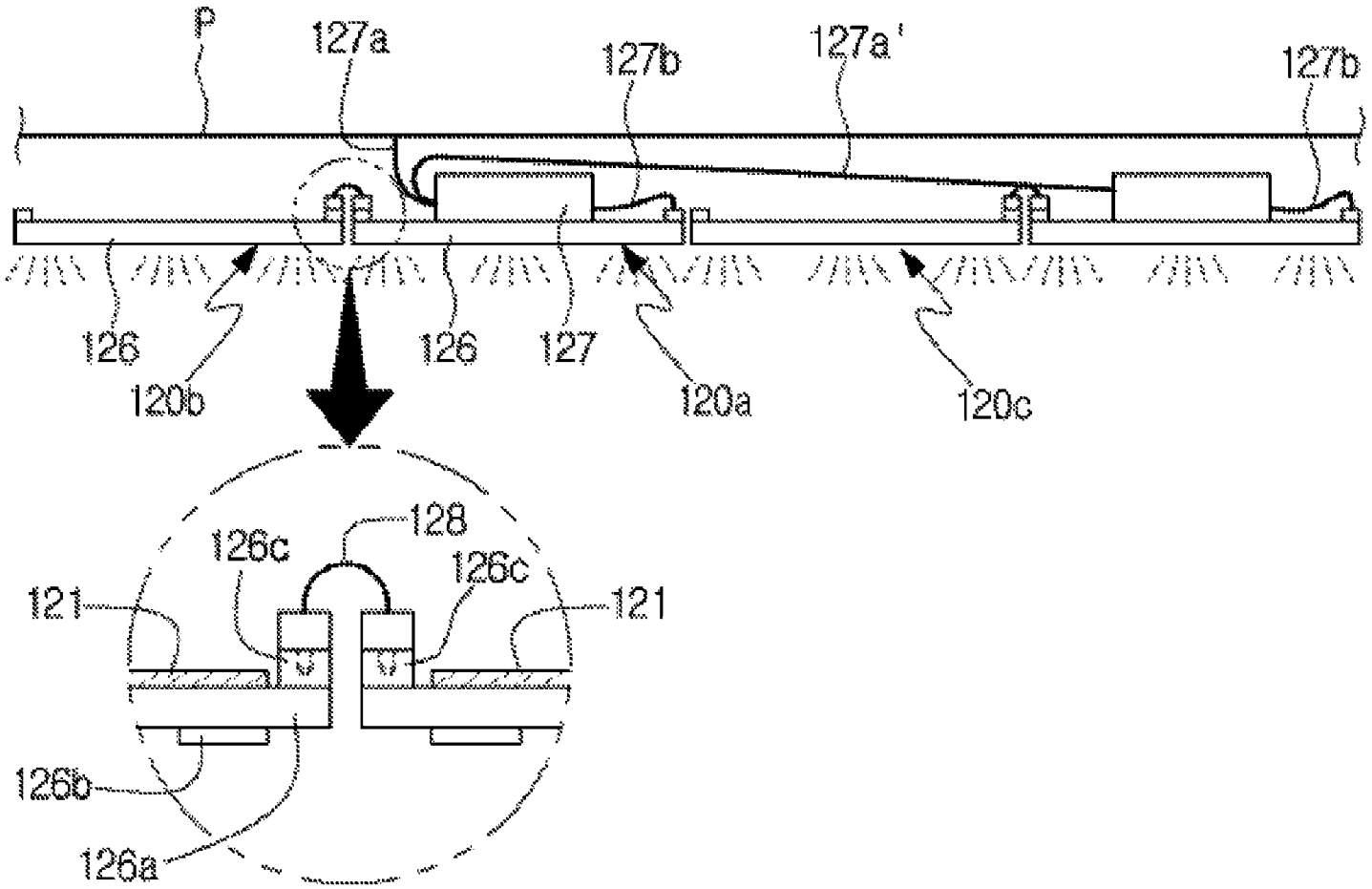
FIG. 9 is a configuration view illustrating a wiring structure of the ceiling-embedded type linear lighting device according to an exemplary embodiment of the present invention.

FIG. 9 is a configuration view illustrating a wiring structure of the ceiling-embedded type linear lighting device according to an exemplary embodiment of the present invention.

FIG. 9 illustrates other components except for the housing and as illustrated in the drawings, the lighting module 120 may be provided in plural and the plurality of lighting modules 120 may be arranged in a row to configure consecutive linear illumination.

In this case, in the event that the plurality of lighting modules 120 receive power by the single SMPS 127 depending on the capacity of the SMPS 127 installed on the lighting module, the plurality of lighting modules 120 may be configured in such a manner that the SMPS 127 may be disposed on at least one of the plurality of lighting modules 120, and the remaining lighting modules 120 on which the SMPS 127 is not disposed may be electrically connected to each other by the connecting line 128 to receive power from the at least one lighting module on which the SMPS 127 is disposed.

More specifically, while a first lighting module 120*a* on which the SMPS 127 is disposed may be installed on the housing 110, an input line 127*a* of the corresponding SMPS 127 may be connected to an external power line P, and an output line 127*b* of the SMPS 127 may be connected to the socket 126*c* provided on the circuit substrate 126*a* of the light emitting body 126.

Next, after disposing a second lighting module 120*b* on which the SMPS 127 is not disposed, in parallel with the first lighting module 120*a*, when a pair of the sockets 126*c* disposed on the ends of a pair of the lighting modules 120*a* and 120*b* may be connected to each other by the connecting line 128, the lighting module 120*b* installed later may receive power from the lighting module 120*a* installed first.

Meanwhile, when a further lighting module 120*c* on which another SMPS 127 is installed is consecutively installed, in the SMPS 127 of the further installed lighting module 120*c*, the input line 127*a* thereof may be connected to the input line 127*a* of the first lighting module 120, whereby a wiring operation performed in an inside space of the installation object C may be significantly reduced.

It is to be understood that the invention is not limited to the disclosed embodiments, but, on the contrary, may be embodied in various embodiments and that various modifications may be made to the invention by one skilled in the art without departing from the spirit and scope of the invention as defiled in the appended claims.

INDUSTRIAL APPLICABILITY

The present invention relates to a ceiling-embedded type linear lighting device and more particularly to, a ceiling-embedded type linear lighting device allowing a lighting module to be simply attached to or detached from a ceiling-embedded type housing, as well as allowing for improvements in utilization efficiency of illumination light of the lighting module.

What is claimed is:

1. A ceiling-embedded type linear lighting device comprising:

a housing having a receiving space formed therein and having an open side at one end; and at least one lighting module including: a light emitting body including a plurality of light emitting devices disposed on a substrate in a length direction thereof, a fixing plate allowing the light emitting body to be fixed thereto, and elastic portions disposed to be inclined from both side surfaces of the fixing plate so as to be elastically supported by an inside surface of the housing at the receiving space, so that the lighting module is vertically, detachably coupled to an interior of the receiving space from a front of the open side of the receiving space of the housing, wherein the elastic portions and the inside surface of the housing at the receiving space are provided with a first coupling portion and a second coupling portion, the first coupling portion and the second coupling portion being engaged with each other and wherein the lighting module is provided with a switching mode power supply (SMPS) for stably supplying power to the light emitting devices of the light emitting body, and sockets are provided on the substrate of the light emitting body so as to provide connection of power between substrates, the sockets of the substrate being connected to each other by a connection line to thereby allow a plurality of light emitting bodies to stably receive power by a single SMPS.

2. The ceiling-embedded type linear lighting device according to claim 1, wherein an inside surface of at least one of the fixing plate and the elastic portions of the lighting module is provided with a reflective surface reflecting illumination light of the light emitting devices toward the open side of the receiving space.

3. The ceiling-embedded type linear lighting device according to claim 1, wherein a handle portion is extended from the end portion of the elastic portions so as to release the engagement of the first coupling portion with the second coupling portion, the handle portion being spaced apart from the inside surface of the housing at the receiving space.

4. The ceiling-embedded type linear lighting device according to claim 3, wherein at least one of the surfaces on which the first coupling portion and the second coupling portion are engaged with each other is formed as an inclined surface guiding a separation of the lighting module.

5. The ceiling-embedded type linear lighting device according to claim 4, further comprising:

stopper members which protrude from the inside surface of the housing and guide an insertion position of the fixing plate.

6. The ceiling-embedded type linear lighting device according to claim 5, wherein rail grooves are formed in the inside surface of the housing in a length direction thereof, and the stopper members are movably inserted into and supported by the rail grooves.

7. The ceiling-embedded type linear lighting device according to claim 1, further comprising:

a light transmissive cover which closes the open side of the housing.

8. The ceiling-embedded type linear lighting device according to claim 1, wherein the switching mode power supply (SMPS) is provided in plural and each of the plurality of switching mode power supplies (SMPS) is provided with an input line receiving power and an output line supplying the power to the light emitting devices, and wherein the input line of one of the plurality of switching mode power supplies (SMPS) is connected to an external power line, and an input line of at least one of the remaining switching mode power supplies (SMPS) is connected to the input line of the switching mode power supply (SMPS) receiving power from the external power line.

9. The ceiling-embedded type linear lighting device according to claim 1, further comprising:

a fixing member having inclined portions inclined downwardly from both sides thereof and disposed on an upper portion of the housing; and a connecting member connecting the fixing member and the housing to each other to allow the fixing member to move in a vertical direction, wherein supporting jaw portions are formed to protrude from both side surfaces of an end portion of the open side of the housing, and wherein, in a state in which the upper portion of the housing is inserted in an installation groove provided in an installation object, the inclined portions penetrate through the installation groove and are supported by an inside surface of the installation object, and the supporting jaw portions are supported by an outside surface of the installation object.

10. The ceiling-embedded type linear lighting device according to claim 9, wherein the inclined portions are elastically supported in a direction apart from the side surface of the housing.

11. The ceiling-embedded type linear lighting device according to claim 10, wherein a supporting portion is formed on the end portion of the inclined portions supported by the inside surface of the installation object, the supporting portion being disposed at right angle with respect to the inside surface of the installation object.

12. The ceiling-embedded type linear lighting device according to claim 9, wherein the connecting member includes a central plate connecting the inclined portions disposed on the both side surfaces of the housing.

13. The ceiling-embedded type linear lighting device according to claim 12, wherein the connecting member has a front end thereof which penetrates through the housing and which is screw-coupled with the central plate of the fixing member and a rear end thereof supported by the housing.

* * * * *